US012760903B2

(12) United States Patent
Zhang et al.

(10) Patent No.: US 12,760,903 B2
(45) Date of Patent: Oct. 13, 2026

(54) OUTDOOR FURNACE TABLE

(71) Applicant: SHINERICH INDUSTRIAL LTD., Shenzhen (CN)

(72) Inventors: Guangrong Zhang, Shenzhen (CN); Qiong Liang, Shenzhen (CN)

(73) Assignee: SHINERICH INDUSTRIAL LTD., Shenzhen (CN)

( * ) Notice: Subject to any disclaimer, the term of this patent is extended or adjusted under 35 U.S.C. 154(b) by 375 days.

(21) Appl. No.: 18/397,032

(22) Filed: Dec. 27, 2023

(65) Prior Publication Data

US 2024/0219033 A1 Jul. 4, 2024

(30) Foreign Application Priority Data

Dec. 30, 2022 (CN) ..... 202223606952.7

(51) Int. Cl.
*A47B 37/04* (2006.01)
*F24C 3/04* (2021.01)
*F24C 3/12* (2006.01)

(52) U.S. Cl.
CPC ..... *F24C 3/042* (2013.01); *A47B 37/04* (2013.01); *F24C 3/122* (2013.01)

(58) Field of Classification Search
CPC ..... F24C 3/042; F24C 3/122; A47B 37/042
USPC ..... 126/92 AC
See application file for complete search history.

(56) References Cited

U.S. PATENT DOCUMENTS 3,830,217 A * 8/1974 Maness ..... F24B 1/1808 239/18
5,060,629 A * 10/1991 Sirand ..... F24C 3/042 431/329
6,790,033 B2 * 9/2004 Grady ..... F24B 1/192 239/18
9,316,401 B1 * 4/2016 Guste ..... A47J 37/0713
2008/0163863 A1 * 7/2008 Thomas ..... F24C 3/022 126/512
2008/0272109 A1 * 11/2008 Bland ..... F24C 15/30 219/218

* cited by examiner

*Primary Examiner* — Avinash A Savani
(74) *Attorney, Agent, or Firm* — Westbridge IP LLC

(57) ABSTRACT

Disclosed is an outdoor furnace table, including: a box body, an under-table heating portion, a reflecting structure, a fire pan portion and a fuel supply system. The box body is formed with an installation channel, a side end of the box body is provided with a heating hole, an upper end of the box body is provided with a table plate, and the table plate is provided with a fire via port; the under-table heating portion includes a first burner at a lower end of the installation channel; the reflecting structure is provided in the installation channel; the fire pan portion includes a second burner located in the installation channel and above the first burner, a fire generated by the second burner is transmitted through the fire via port; and the fuel supply system is provided in the installation channel.

9 Claims, 8 Drawing Sheets

100

5

OUTDOOR FURNACE TABLE

CROSS-REFERENCE TO RELATED APPLICATIONS

The present application claims priority to Chinese Patent Application No. 202223606952.7, filed on Dec. 30, 2022, the entire contents of which are incorporated herein by reference.

TECHNICAL FIELD

The present application relates to the technical field of outdoor gas furnaces, and in particular to an outdoor furnace table.

BACKGROUND

Currently, some of the bar tables in the market are provided with gas stoves, and some are provided with gas heaters. There are also products provided with gas heaters and gas stoves, which are actually implemented by installing two sets of burners including the gas heater and the gas stove on the same product.

This kind of product usually generates naked fire internally and then installs an infrared cover on the outside to convert the infrared ray for heating, which cannot make sufficient use of energy and can easily cause waste.

SUMMARY

The main purpose of the present application is to provide an outdoor furnace table that improves the heat utilization efficiency.

In order to achieve the above purpose, the outdoor furnace table provided in the present application includes: a box body, an under-table heating portion, a reflecting structure, a fire pan portion and a fuel supply system.

The box body is formed with an installation channel, a side end of the box body is provided with a heating hole, an upper end of the box body is provided with a table plate, and the table plate is provided with a fire via port;

the under-table heating portion includes a first burner at a lower end of the installation channel;

the reflecting structure is provided in the installation channel to reflect a heat generated by the first burner to the heating hole for heating;

the fire pan portion includes a second burner located in the installation channel and above the first burner, a fire generated by the second burner is transmitted through the fire via port; and the fuel supply system is provided in the installation channel and configured to supply a fuel to the first burner and the second burner.

In an embodiment, the first burner includes an infrared burner.

In an embodiment, the reflecting structure includes a conical reflecting plate, and four sides of a quadrangular pyramid are formed downward the conical reflecting plate.

In an embodiment, the outdoor furnace table further includes an air delivering system for supplying an air to the first burner and the second burner.

In an embodiment, the air delivering system includes an air delivering pipe, and the air delivering pipe includes a Venturi ejecting tube.

In an embodiment, the fuel supply system includes a plurality of valves and a plurality of fuel supply pipes, each of the fuel supply pipes is connected to the first burner or the second burner, and each of the fuel supply pipes is provided with the valve; and the valve is configured to control a delivery of the fuel to the first burner or the second burner.

In an embodiment, a protective net is sleeved on an outer periphery of the first burner.

In an embodiment, the outdoor furnace table further includes a thermocouple provided above the first combustion and/or the second burner, the fuel supply system includes a fuel supply pipe, a solenoid valve is provided on the fuel supply pipe, and the thermocouple is connected to the solenoid valve.

In an embodiment, a glass fence is provided at the fire via port, and a burning medium is provided inside the glass fence.

In an embodiment, the burning medium includes at least one of a glass stone and a volcanic stone.

In the technical solution of the present application, the fire pan portion is provided at the upper end of the installing channel to provide on-table heating, and the under-table heating portion is provided at the lower end of the installing channel to provide under-table heating. This allows users to choose to use only under-table heating or on-table heating according to their needs. The reflecting structure reflects the upward emitted infrared ray of the first burner to the heating hole. The reflected infrared ray and the originally horizontally propagating infrared ray pass through the heating hole and are irradiated to the outside user, which improves the utilization efficiency of the heat generated by the first burner and improves the utilization efficiency of the infrared ray.

BRIEF DESCRIPTION OF THE DRAWINGS

In order to illustrate the technical solutions in the embodiments of the present application or in the related art more clearly, the following briefly introduces the accompanying drawings required for the description of the embodiments or the related art. Obviously, the drawings in the following description are only part of embodiments of the present application. For those skilled in the art, other drawings can also be obtained according to the structures shown in these drawings without any creative effort.

Figure 1:
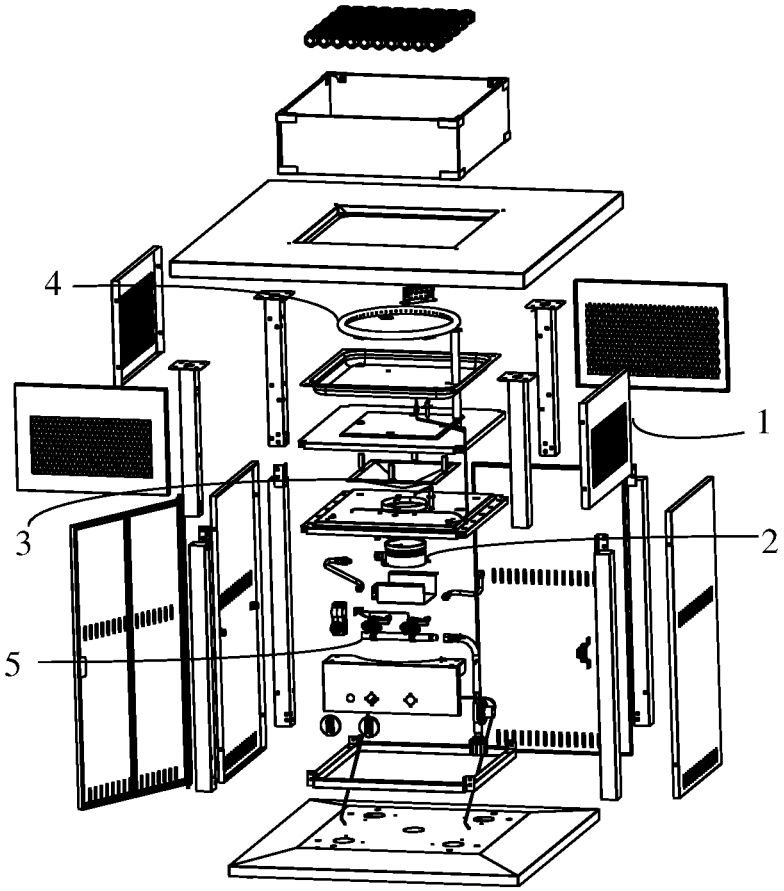
FIG. 1 is a schematic explosive structural view of an outdoor furnace table provided in the present application.

The realization of the objective, functional characteristics, and advantages of the present application are further described with reference to the accompanying drawings.

DETAILED DESCRIPTION OF THE EMBODIMENTS

The technical solutions of the embodiments of the present application will be described in more detail below with reference to the accompanying drawings. It is obvious that the embodiments to be described are only some rather than all of the embodiments of the present application. All other embodiments obtained by those skilled in the art based on the embodiments of the present application without creative efforts shall fall within the scope of the present application.

It should be noted that all directional indications (such as up, down, left, right, front, back, etc.) in the embodiments of the present application are only used to explain the relative positional relationship, the movement situation, etc. among various assemblies under a certain posture as shown in the drawings. If the specific posture changes, the directional indication also changes accordingly.

In addition, the descriptions of "first", "second", etc. are only for the purpose of description, and should not be construed as indicating or implying relative importance or implicitly indicates the number of technical features indicated. Thus, a feature delimited with "first", "second" may expressly or implicitly include at least one of those features. Besides, the technical solutions between the various embodiments can be combined with each other, but must be based on the realization by those skilled in the art. When the combination of technical solutions is contradictory or cannot be realized, it should be considered that the combination of such technical solutions does not exist or fall within the scope of protection claimed in the present application.

Currently, some of the bar tables in the market are provided with gas stoves, and some are provided with gas heaters. There are also products provided with gas heaters and gas stoves, which are actually implemented by installing two sets of burners including the gas heater and the gas stove on the same product.

This kind of product usually generates naked fire internally and then installs an infrared cover on the outside to convert the infrared ray for heating, which cannot make sufficient use of energy and can easily cause waste.

Figure 2:
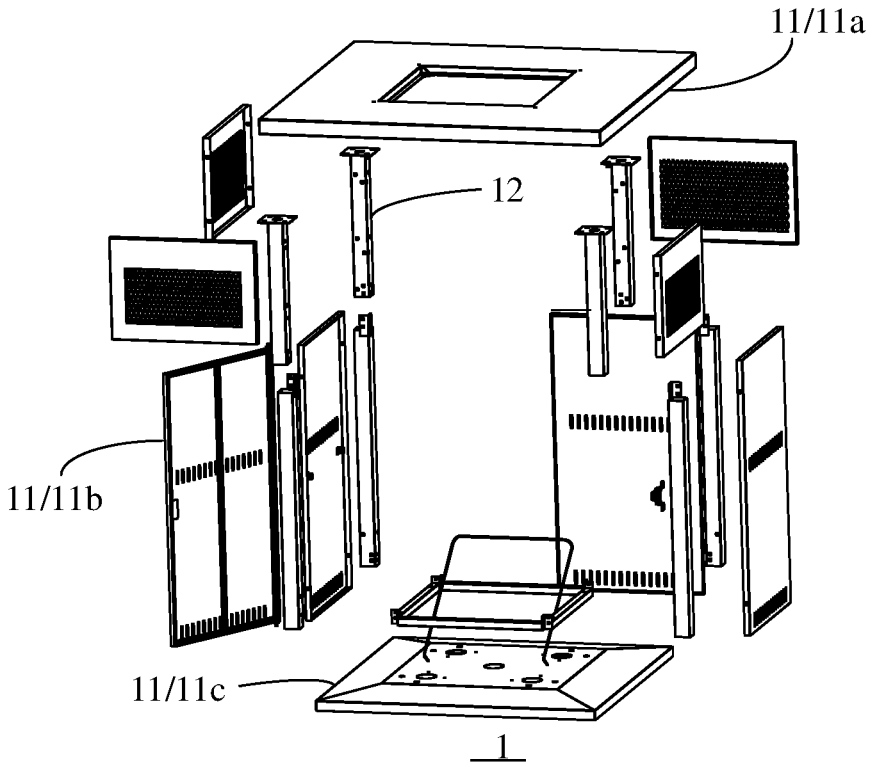
FIG. 2 is a schematic explosive structural view of a box body in FIG. 1.
Figure 3:
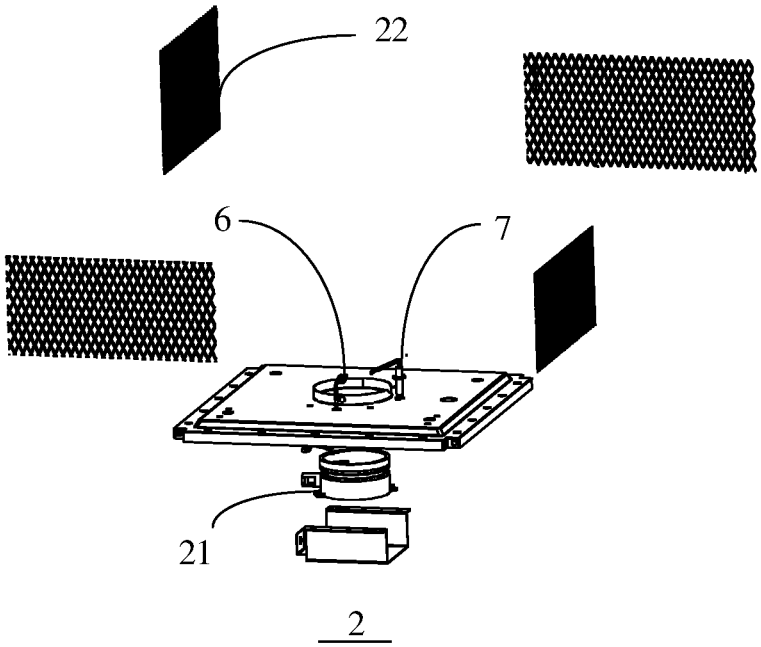
FIG. 3 is a schematic explosive structural view of an under-table heating portion in FIG. 1.
Figure 4:
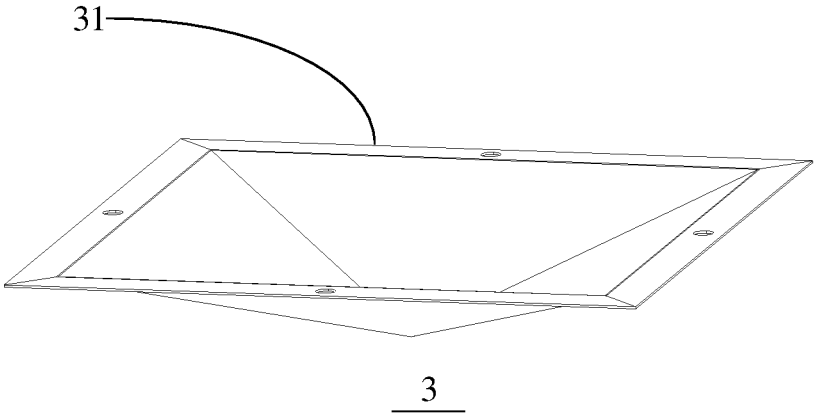
FIG. 4 is a schematic three-dimensional structural view of a reflecting structure in FIG. 1.
Figure 5:
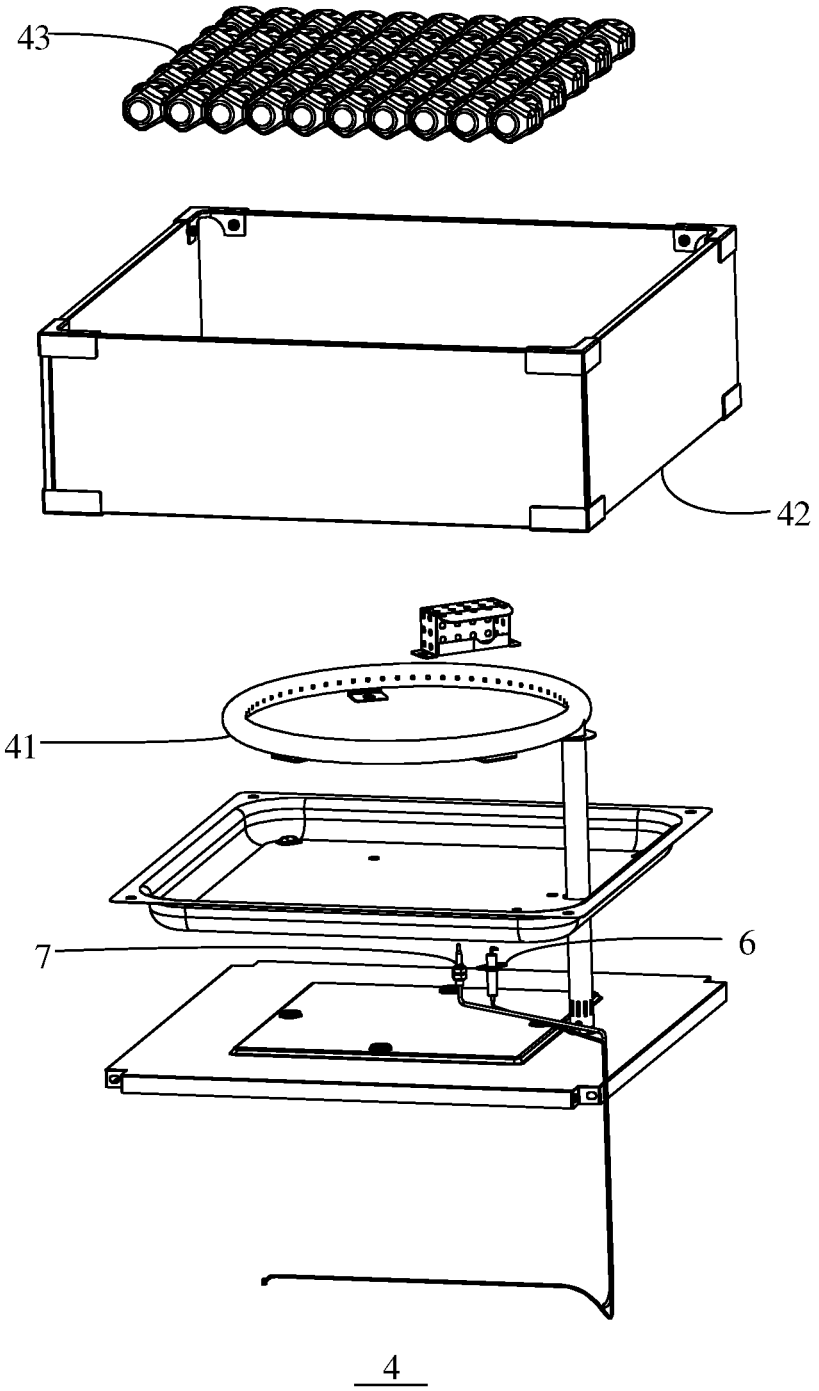
FIG. 5 is a schematic explosive structural view of a fire pan portion in FIG. 1.
Figure 6:
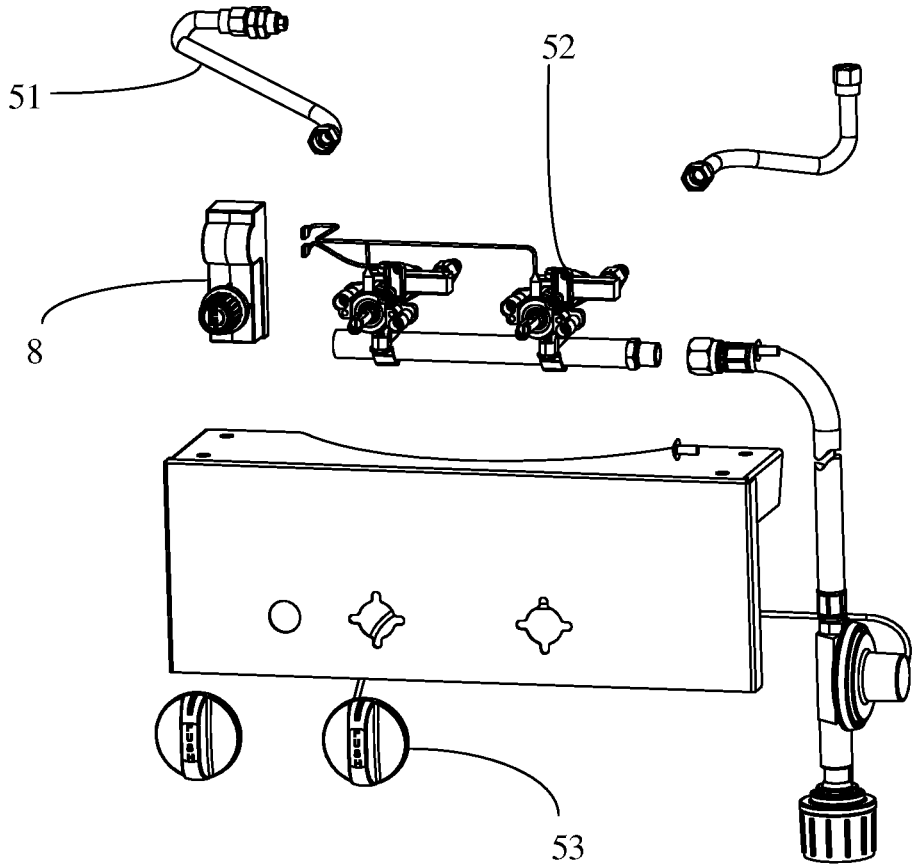
FIG. 6 is a schematic explosive structural view of a fuel delivery structure and an electronic pulser in FIG. 1.
Figure 7:
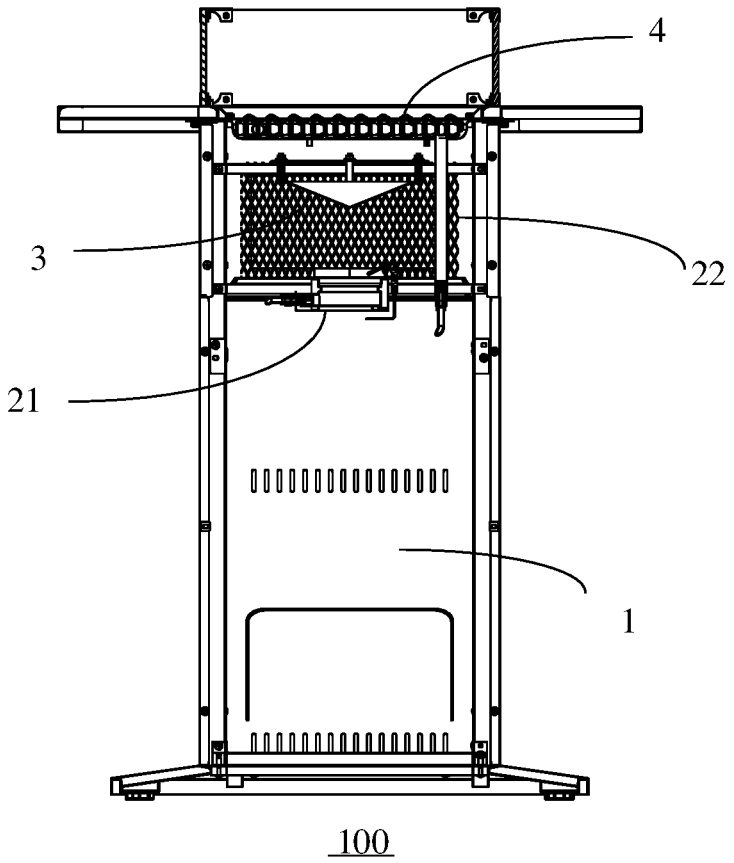
FIG. 7 is a cross-sectional view of a part of the outdoor furnace table in FIG. 1.
Figure 8:
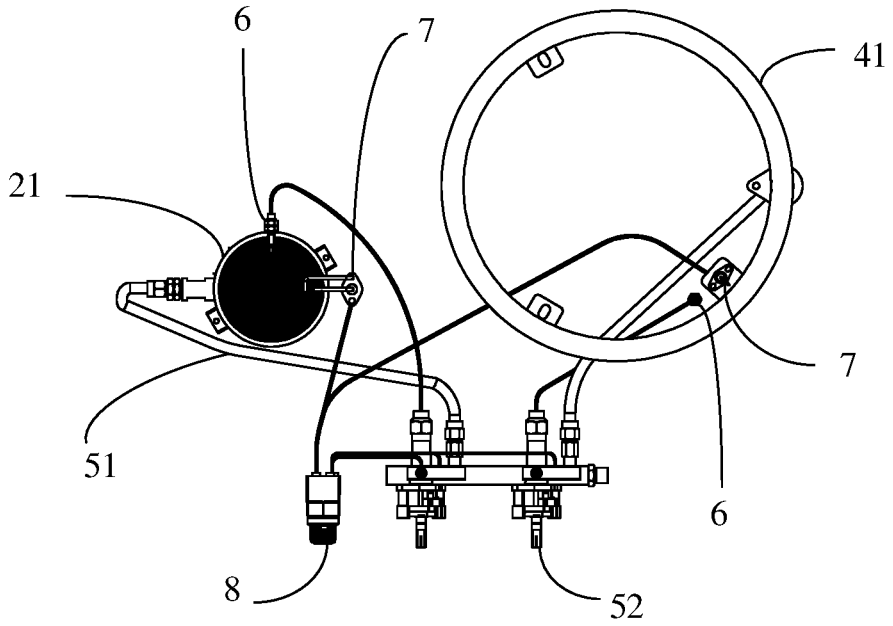
FIG. 8 is a schematic view of a working principle of the outdoor furnace table in FIG. 1.

In order to solve the above problems, the present application provides an outdoor furnace table that improves the heat utilization efficiency. FIG. 1 to FIG. 8 are schematic structural views of the outdoor furnace table according to an embodiment of the present application.

Please refer to FIG. 1 to FIG. 8, the present application provides the outdoor furnace table 100, including a box body 1, an under-table heating portion 2, a reflecting structure 3, a fire pan portion 4 and a fuel supply system 5. The box body 1 is formed with an installation channel, a side end of the box body 1 is provided with a heating hole, an upper end of the box body 1 is provided with a table plate 11*a*, and the table plate 11*a* is provided with a fire via port. The under-table heating portion 2 includes a first burner 21 located at a lower end of the installation channel. The reflecting structure 3 is provided in the installation channel to reflect the heat generated by the first burner 21 to the heating hole for heating the user. The fire pan portion 4 includes a second burner 41 located in the installation channel and above the first burner 21. The fire generated by the second burner 41 can be transmitted through the fire via port. The fuel supply system 5 is provided in the installation channel and is configured to supply the fuel to the first burner 21 and the second burner 41.

In the technical solution of the present application, the fire pan portion 4 is provided at the upper end of the installing channel to provide on-table heating, and the under-table heating portion 2 is provided at the lower end of the installing channel to provide under-table heating, which allows users to choose to use only under-table heating or on-table heating according to their needs. The reflecting structure 3 reflects the upward emitted infrared ray of the first burner 21 to the heating hole. The reflected infrared ray and the originally horizontally propagating infrared ray pass through the heating hole and are irradiated to the outside user, which improves the utilization efficiency of the heat generated by the first burner 21 and improves the utilization efficiency of the infrared ray.

The first burner 21 can use a natural air supply burner with an infrared ray radiation cover, or can use an ejecting burner to directly emit the infrared ray, which is not limited in the present application. In an embodiment, the first burner 21 includes an infrared burner, and a large amount of heat generated by combustion is radiated outward in the form of the infrared ray. The gas is premixed with the air through dispersed gas channels in the infrared burner. Since the size of each of the gas channels is small, the air and the gas in the gas channel can be evenly and completely contacted during combustion, thus the final burning efficiency is high, the heat generation is high, and less exhaust gas is generated. The height of the fire produced during combustion is not high enough to exceed the height of the infrared burner, and no visible naked fire will be produced, so that the infrared burner combustion will not be affected by wind and has a good windproof performance.

The shape of the box body 1 may be a hemisphere or a cylinder, which is not limited in the present application. In an embodiment, the box body 1 is rectangular and includes a plurality of box plates 11. The plurality of the box plates 11 include a table plate 11*a*, a bottom plate 11*b* and a plurality of side box plates 11*b*. The box plates 11 can be disassembled and connected, so that users can assemble by themselves. In an embodiment, the box body 1 also includes a bracket 12 that can be detached into parts, and each part of the bracket 12 is detachably connected. Each part of the bracket 12 is extended along each edge of the box body 1 and is detachably connected to the edges of each of the box plates 11, and the bracket 12 increases the strength of the box body 1.

The infrared burner can be a ceramic plate burner or a metal fiber burner, which is not limited in the present application. In an embodiment, in order to reduce costs, the infrared burner uses a cheap ceramic plate burner. There are many small plate holes processed in the ceramic plate burner. The gas is premixed with the air and is burned in the plate holes, the final thermal efficiency can exceed 60%, and the surface temperature of the ceramic plate burner can reach 900° C.

Since the infrared burner has a high burning efficiency and a high heat production, when generating the same heat as an ordinary burner, less gas is required and it is more energy-saving. Moreover, the infrared burner uses a large amount of infrared ray to irradiate the user's body for heating, and the infrared ray has a physical therapy effect on the human body, so that the outdoor heating table can provide the physical therapy to the user.

The second burner 41 can use the natural air supply burner or the ejecting burner, which is not limited in the present application. In an embodiment, the second burner 41 includes a furnace head for generating the naked fire, which can be viewed and give people a warm atmosphere. In an embodiment, the furnace head is a tube furnace head.

The reflecting structure 3 can be covered with reflecting plates above, below and around the first burner 21, or a reflecting inclined plate can be installed above the first burner 21. The reflecting plate can be a glass mirror. The material can also be stainless steel, which is not limited in the present application. In an embodiment, the reflecting structure 3 includes a conical reflecting plate 31 installed between the first burner 21 and the second burner 41. The conical reflecting plate 31 includes four reflecting surfaces arranged in a quadrangular pyramid, so as to reflect the upwardly scattered infrared ray to the four directions of front, rear, left and right. When the outdoor furnace table 100 is used, users usually sit in these four directions, so that the infrared ray can be reflected concentratedly onto the user.

In order to provide sufficient oxygen to the first burner 21 and the second burner 41, the outdoor furnace table 100 also includes an air delivering system. The air delivering system can be provided with a blower on the wall of the box body 1 to blow the air inward, or the pipes can connect the first burner 21 and the second burner 41 to the outer surface of the box body 1, so as to be communicated with the ambient air, which is not limited in the present application. In an embodiment, the air delivering pipe is a Venturi ejecting tube, which is throughly connected to the box plate 11 so that the installation channel is communicated with the outside ambient air. The Venturi ejecting tube changes a cross-sectional area in the pipe through the Venturi effect to accelerate the flow rate of air, accelerates the speed of air transportation in the installation space without consuming energy, and provides continuous and sufficient oxygen for the first burner 21 and the second burner 41. Through the Venturi ejecting tube, 110% to 120% of the oxygen required for combustion can be supplied. Of course, the Venturi ejecting tube can only connect the installation channel and the outside ambient air, or pipes can be connected between the Venturi ejecting tube and the first burner 21 and/or second burner 41, which is not limited in the present application.

The ignition method of the first burner 21 and the second burner 41 can be the piezoelectric ceramic ignition or the electronic pulse ignition, which is not limited in the present application. In an embodiment, the first burner 21 and the second burner 41 use the pulse ignition, and an electrode rod 7 is provided on the first burner 21 or the second burner 41, the electrode rod 7 is connected to the electronic pulser 8, and the electronic pulser 8 is adjusted so that an electric spark is generated by the electrode rod 7 for ignition.

In order to control the first burner 21 and the second burner 41 respectively, in an embodiment, the fuel supply system 5 includes several fuel supply pipes 51, and both the first burner 21 and the second burner 41 are connected to at least one fuel supply pipe 51. A valve 52 is provided on any fuel supply pipe 51, so that the user can adjust the fuel supply amount to the first burner 21 and the second burner 41. A rotating knob 53 can be connected to an outside of the valve 52 to facilitate a manual control. The valve 52 can also be a solenoid valve, which can be controlled by a control circuit.

In order to prevent the user from being scalded due to contact with the first burner 21, a protective net 22 is sleeved on a periphery of the first burner 21. The material of the protective net 22 can be asbestos or glass fiber, which is not limited in the present application. In an embodiment of the present application, the first burner 21, the protective net 22, and the box body 1 are arranged outward in sequence, and each of the box plates 11 surrounds the protective net 22. In this way, when opening each of the box plates 11 of the box body 1 and operating inside the box body 1, the user will not be directly contacted with the first burner 21. In an embodiment of the present application, a large hole is opened on the inner wall of the side box plate 11*b*, and the protective net 22 is connected to the inner wall of the side box plate 11*b* to cover the large hole. The mesh of the protective net 22 serves as a heating hole, and the protective net 22 prevents the user from directly contacting the first burner 21 from outside the box body 1. In an embodiment, the protecting net 22 is an iron mesh.

In order to prevent the first burner 21 and the second burner 41 from overheating and causing safety problems, in an embodiment, a protection device is provided. The protection device includes a thermocouple 6 respectively spaced above the first burner 21 and the second burner 41. The thermocouple 6 is also connected to the solenoid valve provided on the fuel supply pipe 51. If the naked fire generated by the first burner 21 or the second burner 41 burns to the thermocouple 6, the thermocouple 6 generates an electric signal and transmits the electric signal to the solenoid valve, so that the solenoid valve reduces or interrupts the fuel supply to the first burner 21 or the second burner 41 to achieve overheating protection.

In order to prevent the user from being scalded by a direct contact with the fire or the heat of the second burner 41, in an embodiment, the fire pan portion 4 further includes a glass fence 42 sleeved outside the first burner 21. The glass fence 42 protrudes upward from the table plate 11*a*, and separates the second burner 41 from the outside world on the horizontal plane. Since the glass fence 42 is transparent, the fire or heat generated inside can be views through the glass fence 42. The glass fence 42 can be directly connected to the table plate 11*a*, or can be connected to the inner wall of the side box plate 11*b*, which is not limited in the present application. The glass enclosure also shields the second burner 41 from interference from the outside wind.

In the glass fence 42 of the fire pan portion 4, a burning medium 43 may be provided above the second burner 41. The burning medium 43 absorbs the heat generated by the second burner 41 and releases the heat to the outside. This delayed heat release can prevent the temperature of the upper part of the fire pan portion 4 from being too high, thereby protecting the user from being scalded. The material of the burning medium 43 may be glass or volcanic rock, which is not limited in the present application. In an embodiment, the burning medium 43 includes a plurality of separate burning medium blocks, and gaps are formed between different burning medium blocks for naked fire to pass through. A net is provided between the burning medium block and the second burner 41 to support the burning medium block. The support net may be internally connected to the inner periphery of the glass fence 42, or may be connected to the lower surface of the table, which is not limited in the present application.

The above descriptions are only embodiments of the present application, and are not intended to limit the scope of the present application. Under the inventive concept of the present application, any equivalent structural transformations made by using the contents of the description and drawings of the present application, or direct/indirect applications in other related technical fields are included in the scope of the present application.

What is claimed is:

1. An outdoor furnace table, comprising:

a box body formed with an installation channel, wherein a side end of the box body is provided with a heating hole, an upper end of the box body is provided with a table plate, and the table plate is provided with a fire via port;

an under-table heating portion comprising a first burner at a lower end of the installation channel;

a reflecting structure provided in the installation channel to reflect a heat generated by the first burner to the heating hole for heating;

a fire pan portion comprising a second burner located in the installation channel and above the first burner, wherein a fire generated by the second burner is transmitted through the fire via port; and a fuel supply system provided in the installation channel and configured to supply a fuel to the first burner and the second burner;

wherein the reflecting structure comprises a conical reflecting plate, and four sides of a quadrangular pyramid are formed downward the conical reflecting plate to reflect an upwardly scattered infrared ray to four directions of front, rear, left and right.

2. The outdoor furnace table of claim 1, wherein the first burner comprises an infrared burner.

3. The outdoor furnace table of claim 1, further comprising an air delivering system for supplying an air to the first burner and the second burner.

4. The outdoor furnace table of claim 3, wherein the air delivering system comprises an air delivering pipe, and the air delivering pipe comprises a Venturi ejecting tube.

5. The outdoor furnace table of claim 1, wherein the fuel supply system comprises a plurality of valves and a plurality of fuel supply pipes, each of the fuel supply pipes is connected to the first burner or the second burner, and each of the fuel supply pipes is provided with the valve; and the valve is configured to control a delivery of the fuel to the first burner or the second burner.

6. The outdoor furnace table of claim 1, wherein a protective net is sleeved on an outer periphery of the first burner.

7. The outdoor furnace table of claim 1, further comprising a thermocouple provided above the first burner and/or the second burner, wherein the fuel supply system comprises a fuel supply pipe, a solenoid valve is provided on the fuel supply pipe, and the thermocouple is connected to the solenoid valve.

8. The outdoor furnace table of claim 1, wherein a glass fence is provided at the fire via port, and a burning medium is provided inside the glass fence.

9. The outdoor furnace table of claim 8, wherein the burning medium comprises at least one of a glass stone and a volcanic stone.

* * * * *